US007094474B2

(12) United States Patent
Leigh et al.

(10) Patent No.: US 7,094,474 B2
(45) Date of Patent: Aug. 22, 2006

(54) COMPOSITE POWDER AND GALL-RESISTANT COATING

(75) Inventors: Sang-Ha Leigh, Chillicothe, IL (US); Hyung K. Yoon, Peoria, IL (US)

(73) Assignee: Caterpillar, Inc., Peoria, IL (US)

( * ) Notice: Subject to any disclaimer, the term of this patent is extended or adjusted under 35 U.S.C. 154(b) by 0 days.

(21) Appl. No.: 10/869,064

(22) Filed: Jun. 17, 2004

(65) Prior Publication Data

US 2005/0279186 A1 Dec. 22, 2005

(51) Int. Cl.
*B32B 15/04* (2006.01)

(52) U.S. Cl. ..... 428/655; 428/663; 428/668; 428/674

(58) Field of Classification Search ..... 428/615, 428/648, 663, 668, 674
See application file for complete search history.

(56) References Cited

U.S. PATENT DOCUMENTS

| | | | | |
|---|---|---|---|---|
| 3,819,384 | A | 6/1974 | Ingham, Jr. et al. | |
| RE28,552 | E | 9/1975 | Smith | |
| 3,941,903 | A * | 3/1976 | Tucker, Jr. | 427/451 |
| 3,991,240 | A | 11/1976 | Harrington et al. | |
| 4,196,237 | A | 4/1980 | Patel et al. | |
| 4,389,251 | A | 6/1983 | Simm et al. | |
| 4,649,086 | A | 3/1987 | Johnson | |
| 4,822,415 | A | 4/1989 | Dorfman et al. | |
| 5,080,056 | A * | 1/1992 | Kramer et al. | 123/193.4 |
| 5,334,235 | A * | 8/1994 | Dorfman et al. | 75/255 |
| 5,540,750 | A * | 7/1996 | Fernandez et al. | 75/235 |
| 5,603,076 | A | 2/1997 | Sampath | |
| 5,753,725 | A * | 5/1998 | Kondoh et al. | 523/149 |
| 5,843,243 | A | 12/1998 | Kawasaki et al. | |
| 5,958,522 | A | 9/1999 | Nakagawa et al. | |
| 6,027,145 | A | 2/2000 | Tsuru et al. | |
| 6,145,941 | A | 11/2000 | Anderton et al. | |
| 6,158,963 | A | 12/2000 | Hollis et al. | |
| 6,214,080 | B1 | 4/2001 | Narasimhan et al. | |
| 6,379,754 | B1 * | 4/2002 | Schlegel et al. | 427/446 |
| 6,544,597 | B1 | 4/2003 | Takahashi et al. | |
| 2003/0209103 | A1 | 11/2003 | Takayama et al. | |

FOREIGN PATENT DOCUMENTS

| | | |
|---|---|---|
| JP | 55034601 A | 3/1980 |
| JP | 56044762 A | 4/1981 |
| JP | 2-120575 | 5/1990 |

* cited by examiner

*Primary Examiner*—Ngoclan T. Mai
(74) *Attorney, Agent, or Firm*—Finnegan, Henderson, Farabow, Garrett & Dunner LLP

(57) ABSTRACT

A composite powder includes an FeMo based first powder including between about 20% and about 55% by weight Fe and between about 45% and about 80% by weight of Mo. The composite powder also includes an aluminum bronze based second powder blended with the FeMo based first powder.

8 Claims, No Drawings

COMPOSITE POWDER AND GALL-RESISTANT COATING

TECHNICAL FIELD

The present disclosure relates generally to a composite powder and more particularly to a composite powder feedstock and method for providing a gall-resistant coating on a component.

BACKGROUND

Galling is a condition that occurs as a result of friction between two metal surfaces, which may be found, for example, at mating surfaces of two components in sliding contact. Heat generated by friction can cause localized welding and metal transfer between the metal surfaces. This localized welding and metal transfer has the effect of roughening the surface topography of the contacting metal surfaces. The roughened surfaces cause even more friction and contribute to further galling, which can ultimately cause unacceptable performance degradation or failure of the sliding components.

One way to impart added wear resistance to sliding surfaces of mating components may include increasing the surface hardness of the sliding components. While such an increase in hardness may increase wear resistance of the components, harder materials may lack sufficient lubricity to effectively reduce friction between the sliding surfaces. Thus, galling may still occur.

In certain applications, galling may be minimized or avoided by adding a lubricious layer of relatively soft metal between sliding surfaces of the mating components. Merely adding a soft metal layer to the sliding surfaces, however, may be inappropriate for certain applications. For example, many sliding components operate in harsh environments that may include high temperatures and high bearing loads. Thus, for certain applications, a gall-resistant coating may be required to exhibit a combination of properties including high lubricity and sufficient hardness to withstand a particular set of environmental conditions. Generating such a coating can be challenging and may include the use of multiple constituents to provide a desired combination of physical properties.

U.S. Pat. No. 6,544,597 to Takahashi et al. (the '597 patent) describes a method and apparatus for generating a coating for a sliding component using a combination of materials. Specifically, the '597 patent describes a mixed powder plasma spraying technique in which both an iron based powder and an aluminum based powder are separately fed to a plasma spray apparatus. In the method of the '597 patent, these powders are melted in the plasma spray and deposited together as a surface coating.

While the method of the '597 patent may potentially produce adequate gall-resistant coatings, this method has several shortcomings. For example, providing the iron and aluminum based constituents separately to the plasma spray apparatus requires a complicated scheme for controlling the precise ratios and feed rates of the different materials needed to generate a desired coating. Also, the plasma spray technique of the '597 patent tends to produce coatings with low densities and high levels of oxidation, which may result in brittle coatings. Further, the coatings made by the plasma spray method of the '597 patent can suffer from low bond strength due to high porosity and tensile residual stresses in the plasma-spray-deposited coatings.

The disclosed coating and method are directed to overcoming one or more of the problems set forth above.

SUMMARY OF THE INVENTION

In one aspect, the present disclosure is directed to a composite powder that includes an FeMo based first powder including between about 20% and about 55% by weight Fe and between about 45% and about 80% by weight of Mo. The composite powder also includes an aluminum bronze based second powder blended with the FeMo based first powder.

In another aspect, the present disclosure is directed to a method of forming a gall-resistant coating. The method may include obtaining a composite powder feedstock that includes a mixture of an FeMo based powder and an aluminum bronze powder and supplying the composite powder feedstock to a deposition apparatus. Using the deposition apparatus, a gall-resistant coating may be deposited on a substrate.

In another aspect, the present disclosure is directed to a gall-resistant component including a substrate having at least one wear surface. A coating may be deposited at least partially on the at least one wear surface, and the coating may include about 8% to about 55% by weight Fe, about 15% to about 80% by weight Mo, about 8% to about 60% by weight Cu, and about 0.5% to about 15% by weight Al.

DETAILED DESCRIPTION

The present disclosure relates to a feedstock material and a deposition process for providing a gall-resistant coating on a substrate. The disclosure also relates to various components including a gall-resistant coating.

The feedstock material may include any material that may be supplied to a deposition apparatus such as, for example, a high velocity oxygen fuel (HVOF) apparatus or a detonation gun (D-gun) apparatus. The feedstock material may include a composite powder having two or more constituents. In one embodiment, the composite powder may include an iron based powder blended with a copper based powder. The iron based powder may include an FeMo based powder, for example, and the copper based powder may include an aluminum bronze based powder.

The ratio of FeMo based powder to aluminum bronze based powder may be a primary factor in producing a desired set of physical characteristics in the deposited gall-resistant coating. In one exemplary embodiment, the FeMo based powder may constitute between about 25% to about 99% by weight of the composite powder, and the aluminum bronze based powder may constitute between about 1% and about 75% by weight of the composite powder. In another embodiment, the FeMo based powder may constitute between about 70% to about 95% by weight of the composite powder, and the aluminum bronze based powder may constitute between about 5% and about 30% by weight of the composite powder. In yet another embodiment, the FeMo based powder may constitute between about 40% to about 70% by weight of the composite powder, and the aluminum bronze based powder may constitute between about 30% and about 60% by weight of the composite powder.

Additionally, the percentages of Fe and Mo included in the FeMo based powder constituent may be varied. In one embodiment, the FeMo based powder may include between about 20% and about 55% by weight Fe and between about 45% and about 80% by weight of Mo. In another embodiment, the FeMo based powder may include between about 25% and about 35% by weight Fe and between about 65% and about 75% by weight of Mo. The FeMo based powder constituent may also include minor percentages of other elements depending on a desired application.

Various aluminum bronze based materials may be used to produce the disclosed feedstock material. In one embodiment, the aluminum bronze based powder may include about 80% to about 95% by weight Cu and about 5% to about 20% by weight Al. The aluminum bronze based powder may also include other elements in minor proportions. For example, the aluminum bronze based powder may include less than about 2% by weight of Fe.

The disclosed composite powder feedstock material may have any average particle size suitable for use with a selected deposition technique. In one exemplary embodiment, the composite powder, including the FeMo based powder and aluminum bronze based powder components, may have an average particle size of less than about 70 microns.

Gall-resistant coatings consistent with the present disclosure may be made using a variety of different techniques. In one method, an HVOF apparatus such as the Sulzer Metco Diamond Jet® 2700 may be used to deposit the gall-resistant coatings on a substrate material. In another method, a D-gun apparatus may be used to deposit the gall-resistant coatings. Such deposition methods may include obtaining a composite powder feedstock that includes a mixture of an FeMo based powder and an aluminum bronze powder and supplying the composite powder feedstock to a deposition apparatus (e.g., HVOF or D-gun apparatus). Using the deposition apparatus, a gall-resistant coating including primarily Fe, Mo, Cu, an Al may be deposited on a substrate. The substrate material may be virtually any metal or metal component. It is contemplated, however, that for certain applications, the substrate may be a non-metallic material.

HVOF is a thermal deposition technique that includes a high spray velocity achieved using various techniques. In one method, fuel gas such as propylene, propane, hydrogen or natural gas is combined with oxygen. The mixed fuel and oxygen gases are ejected from a nozzle on an HVOF gun and ignited outside the gun. The coating feedstock material, in powdered form, may be fed axially through and out of the gun using nitrogen as a carrier gas. The ignited gases form a circular flame configuration that surrounds and uniformly heats the powdered spray material as it exits the gun and is propelled to the workpiece surface. As a result of the high kinetic energy transferred to the particles through the HVOF process, the coating material does not need to be fully melted. Instead, the powder particles may be in a molten or semi-molten state such that they flatten plastically as they impact the substrate surface.

The D-gun basically includes a long water cooled barrel with inlet valves for gases and feedstock powder. Oxygen and fuel (e.g., acetylene) are fed into the barrel along with a charge of powder. A spark may be used to ignite the gas mixture and the resulting detonation heats and accelerates the powder to supersonic velocity in the gun barrel. Coatings may be deposited on a substrate by directing the supersonic flow of heated powder particles onto a surface of the substrate. A pulse of nitrogen may be used to purge the barrel after each detonation. This detonation process may be repeated many times per second.

Other steps may also be included in the disclosed deposition method. One or more surfaces of the substrate may be cleaned prior to deposition by, for example, grit blasting. Further, one or more additional coatings may be added to the gall-resistant coating. In one embodiment, an overlayer coating (e.g., a Babbitt layer) for potentially reducing or adjusting the frictional coefficient of the surface of a component may be deposited on the gall-resistant coating. Such an overlayer may include at least one of tin, lead, antimony, and any other material for providing a desired surface characteristic.

INDUSTRIAL APPLICABILITY

The disclosed composite powder feedstock material may be used in conjunction with any suitable deposition apparatus to provide desired gall-resistant coatings. As noted above, HVOF and D-gun deposition devices may be used to deposit these coatings. HVOF and D-gun processes may offer coatings with higher densities, higher bond strength values, and lower levels of oxidation, as compared to other deposition techniques. Further, the composite powder feedstock material may simplify the deposition process by eliminating the need to control the feed rates and proportions of multiple feedstock materials to a deposition apparatus.

Each of the constituents of the composite powder feedstock material may contribute to a desired set of physical characteristics embodied by the gall-resistant coating. For example, the FeMo constituent may contribute to the overall hardness and wear resistance of the coating. The aluminum bronze component, on the other hand, may contribute to the lubricity and scuffing resistance of the coating. Together, the FeMo and aluminum bronze constituents of the composite powder feedstock, in the disclosed quantities, may provide a lubricious, gall-resistant coating with sufficient hardness to resist damage caused by wear and loading.

The disclosed gall-resistant coatings may be applied to any suitable substrate that may benefit from a hard, wear resistant surface that is also resistant to galling. Such substrates may include various components having at least one wear surface (i.e., any surface that may experience friction due to contact with another surface of the same or a different component). The disclosed coatings may be disposed on a portion of the wear surface or may cover substantially of the wear surface of the component. Some components having one or more wear surfaces that may benefit from an application of the disclosed gall-resistant coatings may include various metal components including components found in machine engines or drive trains. One such drive train component may include a thrust button, which is a part that may be located between a final drive gear and an axle of a machine.

The disclosed HVOF-deposited gall-resistant coatings may offer several desirable characteristics. For example, coatings produced by HVOF, which are similar to those coatings produced by the D-gun process, may be dense, strong, and show low residual tensile stress. In some cases, the coatings may even include residual compressive stress, which may contribute to high tensile bond strength characteristics of the deposited coating. Thus, low residual tensile stress or the presence of residual compressive stress may enable coatings of greater thickness than possible with other deposition methods. Further, because of the high kinetic energy of the powder particles in the disclosed HVOF technique, dense and strong coatings may be made even without the feedstock powder particles being fully molten upon impact with a substrate surface.

Coatings deposited according to the disclosed techniques may be chemically related to the composite powder feedstock materials used to produce the coatings. In one exemplary embodiment, the coatings may include about 8% to about 55% by weight Fe, about 15% to about 80% by weight Mo, about 8% to about 60% by weight Cu, and about 0.5% to about 15% by weight Al.

The deposited coatings, while being resistant to galling, may also offer relative high hardness and tensile bond strength values. For example, the coatings may include a Knoop hardness value of between about 330 to about 550 using a 500 gram load. In other embodiments, the coatings may have a Knoop hardness value of between about 340 to about 380 using a 500 gram load. Additionally, the coatings may exhibit a tensile bond strength of at least 8000 psi. In other embodiments the coatings may have a tensile bond strength of at least 10,000 psi.

The disclosed gall-resistant coatings may also include one or more overlayer coatings. These overlayer coatings may include at least one of tin, lead, and antimony. Any suitable material, however, may be used in the overlayer depending on a desired set of surface characteristics.

It will be apparent to those skilled in the art that various modifications and variations can be made to the disclosed embodiments without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A gall-resistant component comprising:

a substrate having at least one wear surface; and a coating deposited at least partially on the at least one wear surface;

wherein the coating includes about 8% to about 55% by weight Fe, about 15% to about 80% by weight Mo, about 8% to about 60% by weight Cu, and about 0.5% to about 15% by weight Al.

2. The component of claim 1, wherein the coating has a Knoop hardness value of between about 330 to about 550 using a 500 gram load.

3. The component of claim 1, wherein the coating has a Knoop hardness value of between about 340 to about 380 using a 500 gram load.

4. The component of claim 1, wherein the coating has tensile bond strength of at least 8000 psi.

5. The component of claim 1, wherein the coating has tensile bond strength of at least 10,000 psi.

6. The component of claim 1, further including an overlayer disposed on the coating, the overlayer including at least one of tin, lead, or antimony.

7. The component of claim 1, wherein the component is a drivetrain component for a machine.

8. The component of claim 1, wherein the component is a thrust button.

* * * * *